US012516529B2

(12) United States Patent
Piérard et al.

(10) Patent No.: US 12,516,529 B2
(45) Date of Patent: Jan. 6, 2026

(54) MACHINE FOR TREATING A CONCRETE SURFACE

(71) Applicant: TOPP & SCREED, Soleuvre (LU)

(72) Inventors: Baudouin Piérard, Leglise (BE); Philippe Robinet, Bouillon (BE); Serge Duhautpas, Ettelbruck (LU)

(73) Assignee: Topp & Screed, Luxembourg (BE)

( * ) Notice: Subject to any disclaimer, the term of this patent is extended or adjusted under 35 U.S.C. 154(b) by 799 days.

(21) Appl. No.: 17/899,761

(22) Filed: Aug. 31, 2022

(65) Prior Publication Data

US 2024/0068247 A1 Feb. 29, 2024

(51) Int. Cl.
*E04F 21/24* (2006.01)
*E01C 19/42* (2006.01)

(52) U.S. Cl.
CPC ..... *E04F 21/241* (2013.01); *E01C 19/42* (2013.01)

(58) Field of Classification Search
CPC ..... E04F 21/241; E01C 19/42
USPC ..... 404/75, 118–120
See application file for complete search history.

(56) References Cited

U.S. PATENT DOCUMENTS

| | | | | |
|---|---|---|---|---|
| 3,970,405 | A * | 7/1976 | Swisher, Jr. | E01C 19/407 404/105 |
| 4,655,633 | A | 4/1987 | Somero et al. | |
| 4,789,266 | A * | 12/1988 | Clarke, Jr. | E01C 19/187 404/96 |
| 5,224,793 | A * | 7/1993 | De Pol | E04G 21/10 404/114 |
| 9,028,168 | B1 * | 5/2015 | Knapp | E01C 7/00 404/85 |
| 10,233,658 | B1 * | 3/2019 | Ligman | E01C 19/187 |
| 11,560,727 | B2 * | 1/2023 | Ligman | E01C 19/40 |
| 2007/0116520 | A1 | 5/2007 | Quenzi et al. | |
| 2015/0000168 | A1 * | 1/2015 | Maus | B60D 1/50 280/446.1 |

FOREIGN PATENT DOCUMENTS

| | | | |
|---|---|---|---|
| WO | 2019/126107 | A1 | 6/2019 |
| WO | 2020/076468 | A1 | 4/2020 |

* cited by examiner

*Primary Examiner* — Raymond W Addie
(74) *Attorney, Agent, or Firm* — Morgan, Lewis & Bockius LLP

(57) ABSTRACT

This invention relates to a treating machine (1) for a concrete surface comprising a treating tool (2) mechanically coupled to one end of a telescopic arm (3), a chassis (5) in which a compartment for the arm (3) is formed, and two axles (61, 62) attached at the level of two respective end segments (51, 52) of the chassis (5) each supporting at least one wheel (41, 42). The wheels (41, 42) are orientable and their arrangement via the above-mentioned axles (61, 62) and the chassis (5) is such that they allow the machine (1) to be supported regardless of the position of the tool (2) and the arm (3).

16 Claims, 2 Drawing Sheets

MACHINE FOR TREATING A CONCRETE SURFACE

TECHNICAL FIELD

The present invention relates to a machine for treating a concrete surface.

PRIOR ART

To treat a concrete surface, it is known to use a machine equipped with a dedicated tool. In some cases, the tool is attached against the chassis of the machine, which moves as the surface is treated. This type of machine is typically small in size and low in power. It is used for small surface areas. In other cases, the tool is mechanically coupled to the end of a telescopic arm, referred to as boom, so as to be movable over the surface in a direction of extension of the arm from a base unit. With the arm extending over distances of typically 4 to 9 meters or more, it is possible to quickly treat a concrete strip surface from a single position and orientation of the machine. It is precisely this type of machine with boom that is the object of the present invention.

An example of a known concrete surface treating is the levelling of the uncured concrete, also referred to as "screed". For example, the document EP3728739A1 discloses an embodiment of a machine for levelling a concrete surface equipped with a boom as known in the prior art.

Such a machine usually comprises a hollow compartment for the arm arranged in an upper portion of the base unit. The latter also comprises a lower portion that is coupled to the upper portion and around which the upper portion can rotate to properly orient the arm and the tool in a given position of the machine. The displacement of the machine can be obtained via two axles each supporting two wheels and attached on the lower portion. As shown as an example in FIG. 1 of the cited document, each of the two axles extends along the direction of extension, the axles being aligned along a direction orthogonal to that of extension of the arm. The wheels allow the machine to move in this orthogonal direction between the treating of two surfaces. Thus, it is possible to move, by means of the wheels and to orientate them by rotating the upper portion, the arm and the tool successively between each concrete surface treating.

Although the wheels allow to support the machine when the arm is retracted into the hollow compartment, they are generally not sufficient to stabilize and support the machine in all circumstances, especially when the arm is extended, given the weight of the tool and the arm. For this reason, this type of machine with boom comprises stabilizing feet attached to the lower portion, which are removable and/or adjustable, to support the machine in position when treating the concrete surface. These stabilizing feet also allow you to give the arm the desired incidence. However, the stabilizing feet must be removed and/or adjusted both before and after the treating of each concrete surface. The positioning and stabilization of the machine, as well as the orientation of the arm, before treating a concrete surface therefore takes considerable time on site.

DISCLOSURE OF THE INVENTION

It is an object of the present invention to provide such a machine with boom that allows efficient treating of the concrete surfaces.

For this purpose, the present invention proposes a machine for treating a concrete surface comprising:

- a tool for treating a concrete surface mechanically coupled to one end of a telescopic mechanical arm (i.e. the "boom"), so that the tool is movable over the concrete surface along a direction of extension of the arm;
- a hollow compartment for the arm formed in a chassis of the machine extending mainly along the direction of extension;
- wheels coupled to the compartment and arranged to move the machine;

and wherein the aforesaid chassis comprises two end segments at the level of each of which is attached at least one axle extending transversely to the direction of extension and supporting at least one of the wheels, and preferably two of the wheels on either side of the chassis, the wheels being both orientable and adapted to support the machine.

The machine according to the present invention allow to treat more efficiently the concrete surfaces than the similar machines of the prior art. Indeed, as the wheels of the machine are orientable, the machine is more maneuverable. In particular, it is not necessary to provide a base unit consisting of two portions that are rotatable in relation to each other to orient the arm and the tool, as this orientation can be provided by the wheels. Furthermore, since the wheels are adapted to support the machine, typically for any position of the tool along the extension direction, there is no need for providing stabilizing feet. The wheels alone (i.e. without any other necessary contact with the ground) can directly and completely support and stabilize the machine in position. The treating of concrete surfaces with the machine is thus made more efficient, because it is not necessary to:

- remove or adjust such stabilizing feet prior to treating each surface—which saves considerable time;
- handle both an orientation between two portions of a base unit and an advancement of the wheels in a single direction orthogonal to the extension direction in order to properly position and orient the machine and the tool.

These characteristics related to the wheels, especially their adaptation to support the machine, produce their full effect considering the way they are arranged on the machine, and mechanically coupled to the compartment. Indeed, in order to support, and in particular to stabilize, the machine, it is advantageously provided that the centre of gravity of the machine overcomes or is in a space between the wheels, whatever the position of the tool along the direction of extension. This is a major difficulty that cannot be easily overcome based on an arrangement of the wheels as known in the prior art since the axles of the wheels are then aligned orthogonally to the arm at the level of the end of the arm opposite to the one to which the tool is mechanically coupled. To overcome this, the machine is equipped with a chassis extending mainly along the direction of extension and in which the compartment is formed. The axles are then attached at the level of two end segments of the chassis, along the direction of extension, the axles extending transversely, and preferably perpendicularly, to it. In particular, unlike the machines of the prior art, the axles are necessarily aligned along the direction of extension, and arranged at the level of end segments of the chassis sufficiently far apart along the direction of extension so that the centre of gravity of the machine overcomes or is in a space between the wheels, regardless of the configuration of the machine.

These characteristics, which are intended to allow the wheels to support the machine, could penalize the maneuverability of the machine because they induce the need for a chassis, typically central, extending sufficiently along the direction of extension, in order to be able to attach the axles sufficiently far apart at the level of the end stretches of the chassis. Fortunately, this is not the case because the wheels are orientable and therefore allow the machine to be moved easily in any position, despite its chassis. The orientation characteristic of the wheels is thus intimately related to the technical means in terms of chassis and axle allowing to realize the support characteristic of the machine by the wheels within the technical framework of the present invention.

The chassis is preferably described as central and/or main. It is preferably the only chassis of the machine. In particular, since the wheels are orientable, it is not necessary to provide two separate portions of a base unit as described in the prior art, as the entire machine can be arranged based on a single chassis extended along the extension direction and orientable via the wheels. As the compartment is formed in the chassis, an orientation of the chassis induces an orientation of the arm and thus of the tool. In particular, the chassis is directly connected to the orientable undercarriage of the machine as described above. The compartment is further preferably capable of containing at least 85% of the arm measured along the extension direction, and preferably the entire arm, in a retracted configuration.

Advantageously, the chassis also allows for an even more adequate distribution of the masses of the machine to ensure that the centre of gravity of the machine is positioned above or in a space between the wheels. For example, the heavy elements of the machine such as batteries or motors can be arranged at the level of the end segment of the chassis opposite the tool to counterbalance the weight of the tool. In particular, a mass of a portion of the machine extending in front of (in the direction of deployment of the arm along the direction of extension) the axle attached at the level of the end segment of the chassis closest to the tool is typically less than a mass of a portion of the machine extending behind that axle.

The possible pitching of the chassis is further limited by the arrangement of the wheels via the axles, the undercarriage being preferably rigid. For example, the wheels may comprise solid tires filled with silicone foam, which provides a good rigidity to the wheels. Thus, the tires are not crushed by the motions of the arm when treating a concrete surface.

In the framework of this document, the term "concrete" generally refers, in an uncured state, to a flexible paste of variable homogeneity, preferably comprising a mixture of a sand and a cement, intended to be poured into a dedicated space prior to curing. This occurs after a setting time. The dedicated space is, for example, a support, a mould or a cavity. The concrete is a widely known building material that allows to form very strong coatings or building elements.

In the framework of the present invention, the concrete is preferably poured to form a concrete surface. The term "treating" may refer to different steps of the formation of this surface. For example, the tool may be a tool for levelling the surface of uncured concrete (an operation referred to as "screed") or a finishing tool for applying a finishing powder to the surface (an operation referred to as "spread").

The term "surface" is not to be understood in this document as referring to a strictly two-dimensional (mathematical) object. In particular, as a person skilled in the art would understand, a concrete surface necessarily has a certain thickness of concrete. The term "surface" is used in recognition of the fact that in general, the exterior surface of the concrete once cured and treated is that which is externally visible, typically when designing a concrete coating, floor or slab. For example, before levelling a concrete surface, the uncured concrete poured in the space dedicated to the formation of the surface generally comprises irregularities and variations in thickness forming a relief, hence the need to level this surface with a machine designed for this purpose. This concrete does not only extend two-dimensionally. In general, in the framework of this document, the term "surface" is used interchangeably with the term "extent".

In the framework of this document, the telescopic mechanical arm corresponds to a "boom" as introduced in the prior art. It will be understood by a person skilled in the art that such an arm is distinguished from means of attachment holding the tool against the chassis or from a direct extension of less than 1 meter of these means of attachment. The arm is preferably adapted to extend along the extension direction by at least 4 meters, and preferably by a maximum extension length of between 4 and 9 meters, for example about 5.5 or 6.0 meters, typically when deployed, or alternatively to carry the tool at this distance from the chassis.

In the framework of this document, the term "mainly" in reference to a direction in which a portion of the machine extends corresponds to the fact that this portion of the machine extends (significantly and/or visibly) more along this direction than in other basic directions in the space. In particular, the chassis of the machine extends primarily along the direction of extension of the arm, but of course also along the other two directions of the space that are perpendicular to it and to each other. For example, the chassis extends in these two directions over a variable distance along the direction of extension and between 0.5 and 1.0 meter.

Preferably, at least two of the wheels, and more preferably, all of the wheels are individually and/or independently orientable. Each wheel can thus be oriented in a chosen way independently of the other wheels, and in particular of any wheel coupled to the same axle. A wide range of motions of the machine is thus made possible as illustrated in FIG. 2 below.

Preferably, the axles are directly attached to the chassis. The chassis follows directly the motion induced by the axle and the wheels, simplifying the maneuverability of the machine. The term "direct" is currently used to refer to an attachment preferably without an intermediary. The axles are therefore preferably attached to the chassis and/or extend the chassis.

In the framework of this document, the term "end" segment at the level of which an axle is attached does not necessarily refer to an end of the chassis considered along the direction of extension, but rather to a segment of the chassis located near such an end. According to the above discussion, two segment of the chassis completely located near each ends of the chassis, preferably on either side of the middle of the chassis considered in the direction of extension, can be considered as being "end" segments if, with the axles attached at the level of these segments, the centre of gravity of the machine overcomes or is in a space between the wheels.

In other words, just because the chassis extends, strictly speaking, beyond one of the axles along the direction of extension does not mean that the axle in question is not attached at the level of an end segment of the chassis.

In this sense, the invention can alternatively be introduced as a machine for treating a concrete surface comprising:

a tool for treating a concrete surface mechanically coupled to one end of a telescopic mechanical arm, so that the tool is movable over the concrete surface along a direction of extension of the arm;

a hollow compartment for the arm formed in a chassis of the machine extending mainly along the direction of extension;

wheels supported by axles attached to the chassis to move the machine;

in which the wheels are orientable and arranged (typically with the axles) so that the centre of gravity of the machine overcomes or is in a space between the wheels for any position of the tool along the direction of extension. Said space preferably corresponds to the inner space of a (simple) polygon having the wheels as vertices. Typically, the polygon is a non-square rectangle, for example defined by two parallel axles supporting two wheels at their ends, but the invention is not limited to this geometric shape. The various embodiments and advantages of the invention mentioned above or below apply equivalently to this alternative introduction of the invention.

In this document, the verbs "displace" and "move" and their derivatives are mainly used equivalently.

The use in this document of the verb "comprise", or its variants, as well as their conjugations, does not exclude the presence of elements other than those mentioned. Similarly, the use in this document of the indefinite article "a", "an", or the definite article "the" to introduce an element does not exclude the presence of a plurality of these elements.

According to an embodiment of the invention, a wheelbase of the machine measured along the extension direction is between 35% and 65%, preferably between 40% and 55%, for example about 45%, of a maximum extension length of the arm measured along the extension direction. As it is known to a person skilled in the art, the wheelbase corresponds to the distance separating the axes of the axles furthest apart in the direction of extension. As discussed above, the maximum extension length is generally between 4 and 9 meters, for example about 5.5 or 6.0 meters, when the arm is fully extended. Thus, the wheelbase of the machine is, for example, about 2.5 to 3.0 meters for a boom with a maximum extension length of about 5.5 to 6.5 meters. This is a larger wheelbase than on the machines of the prior art for which it is about 1.6 to 1.9 meters for similar booms.

As discussed above, this particular wheelbase allows to ensure that the centre of gravity of the machine remains in a space between the wheels or overcomes this space at all times, even when the boom is in motion or fully extended. This arrangement of the axles improves the stability of the machine.

Preferably, the wheels are arranged at the vertices of a non-square (planar) rectangle whose longest side extends parallel to the direction of extension. The length of the latter then corresponds to the above-mentioned wheelbase. The length of the axle (measured perpendicular to the direction of extension) is then the length of the smallest side of the rectangle. Preferably, the larger side is at least twice as long, preferably at least three times as long as the smaller side.

According to an embodiment of the invention, each axle comprises:

an axial portion (or axis) extending mainly transversely, preferably perpendicularly, to the direction of extension, from the chassis;

two legs, each of which comprises:

an upper end mechanically coupled to one end of the axial portion by means of preferably mechanical gyration means arranged to allow a rotation relative between the axial portion and the leg, a lower end attached at the level of a hub of one of the wheels.

In particular, each axle according to this embodiment is mechanically coupled and supports two wheels by means of the two legs.

Advantageously, each pair formed by a wheel and a leg is thus adapted to rotate with respect to the rest of the axle, and thus in particular with respect to the chassis, via the gyration means, preferably independently of the other such pairs. The wheels are thus fully orientable thanks to the simple and practical mechanical coupling of the legs with the axial portion. Since the wheels rotate with the legs, the machine is more stable and solid. In particular, the forces within the machine are better absorbed at the level of the axles and wheels. The two legs also allow the wheels to be offset under the plane of the chassis, preferably laterally offset with the chassis, which allows even more support and effective stabilization of the machine. Preferably, the axle is symmetrical on both sides of the extension direction and/or the chassis, which induces a generally symmetrical absorption of the forces within the machine, and thus the stability of the latter.

Preferably, the gyration means comprise a gyration motor mechanically coupled to an orientation ring gear. Preferably, the motor is a hydraulic motor. The orientation ring gear preferably provides a rotational range of at least 180°, preferably 360°. This enables to steer the machine in all directions. These gyration means thus form in particular a rolling. The orientation ring gear allows the power from the hydraulic motor to be adequately transmitted for the rotation of the leg. The orientation ring gear is preferably a ball ring gear. The gyration means may be incorporated in a dedicated and sheltered space between the upper end of the leg and the associated (facing) end of the axial portion, which preferably have a shape mainly extending parallel to the plane defined by the direction of extension (of the arm) and a transverse direction along which the axial portion extends.

Preferably, each leg is arcuate. This shape allows the wheel to be partially surrounded to better support it and thus to better stabilize the machine as a whole. Preferably, the upper and lower ends of the leg are aligned in a direction orthogonal to the extension direction. The wheels extend under the chassis, laterally offset at least partially from it, thus contributing to the efficient support of the whole machine.

Preferably, the wheels of the machine according to the invention, are motorized, more particularly individually motorized. More preferably, each wheel comprises a hub within which a motor, preferably an electric motor, is arranged to advance the wheel.

The advancement of the wheels by means of the respective motors thus allows the machine to be moved quickly and efficiently in any direction defined by the orientation of the wheels. The lower end of each axle leg being attached at the level of, and preferably directly on, the hub of a wheel, for the embodiments concerned, it is possible to use the legs and/or the axial portion of the axle, as well as the chassis to bring connection and/or power supply elements of the electric motor of the wheel to a possible energy source (e.g. batteries) present elsewhere in the machine, preferably at the rear portion of the chassis for balancing the masses according to the extension direction.

In general, the axles (and in particular the legs and/or the axial portions of the axles for the relevant embodiments), and/or the chassis can serve as a service line for the electrical, hydraulic and/or mechanical functions of the machine. This reduces the overall dimension required for the implementation of these functions and protects the power supply, piping and other wiring within the machine. In particular, the energy chain of the machine can be housed in the chassis.

Furthermore, in terms of energy, the machine differs from the concrete surface treating machines known in the prior art in that it is preferably completely electric. More accurately, the machine preferably comprises an electrical power supply, for example, one or more batteries, coupled with one or more electric motors and a hydraulic system to power functionalities of the machine, those functionalities comprising any displacement of the wheel, the arm and the tool. More preferably, all the functionalities of the machine are thus supplied. An orientation of a wheel is considered as a displacement since the wheel turns on itself. As mentioned above, the electric motors can be arranged at the level of the hubs of the wheels for the advancement of the machine, but also at the level of the arm for its deployment according to the extension direction. The hydraulic system preferably comprises hydraulic motors and/or actuators to orient the wheels as described above, and/or to orient the arm (or more precisely, its incidence), for example by modifying an elevation of the wheels, as described below, and/or to modify an elevation of the tool at the end of the arm, also as described below.

The fact that the machine is totally electric, in the sense explained above, allows to avoid the solution of supplying energy to the machine by one or more thermal engines coupled to a hydraulic system as known in the prior art. Indeed, this solution, besides being obviously very polluting and not very ecological, is less energy efficient. It has been shown that the energy efficiency of the machine shown in FIG. 1 below is increased by 30 to 85% compared to the machines known in the prior art. Moreover, as these machines are regularly used in workshops or semi-enclosed sites, it goes without saying that the absence of gas emissions from the combustion of diesel fuel by the thermal engine or engines is beneficial for the health of the operators of these machines and any other workers in the vicinity.

According to a preferred embodiment of the machine of the invention, at least one of the axles comprises elevating means arranged to allow a variation of a distance between the chassis and the at least one wheel, and preferably both wheels, supported by the axle.

This embodiment is very advantageous because it allows the machine operator to adjust the elevation of the wheels by controlling the distance between the chassis and the wheels supported by the axle. It is thus possible to tilt the arm by varying the height of the axle, and thus of the chassis at the level of which it is attached. This allows to compensate for the curvature of the arm, at the level of its end segment carrying the tool, due to the weight of the tool when the arm is extended. It is quite sufficient to incorporate the elevating means in a single axle to achieve this technical effect. The chosen axle can be both the front axle (i.e. closest to the tool) and the rear axle (i.e. farthest from the tool) for example.

Advantageously, the elevating means allow to do without an articulation between the arm and the compartment or an elevation adjustment of stabilizing feet to adjust the inclination of the arm, as used in machines known in the prior art. This contributes to the efficiency of use and simplicity of the machine for treating concrete surfaces.

In the framework of this paper, the term "distance" between two objects refers to the shortest distance between two points each belonging to one of these objects.

Preferably, according to the aforementioned embodiments in which the axle comprises an axial portion and two legs, each leg of said axle equipped with elevating means comprises a pivot connection around which two portions of the leg articulate. The elevating means preferably comprise a hydraulic jack arranged or coupled at the level of this pivot connection. In this way, the variation in height of the axle induces a motion at the level of the pivot connection, like a bent knee for each leg. The hydraulic jack is, for example, coupled to a hydraulic motor forming part of the elevating means which can be arranged at the level of the upper end of the leg. In the framework of this document, the term "hydraulic jack" is used equivalently to the term "hydraulic cylinder".

According to a preferred embodiment of the invention, an electric motor is arranged in the chassis to move the arm by means of a belt, preferably toothed, engaged at the level of the electric motor. It is thus possible to move (and thus to deploy from the compartment and retract into the compartment) the arm only via this electric motor and this belt, without using a hydraulic jack as in the known machines. The machine according to the invention is all the more efficient because the driving power of the arm is no longer limited by the hydraulic jack: it is possible to bias the electric motor to the maximum. This is especially useful when the arm needs to be extended or retracted into the compartment without contact between the tool and the concrete (which is, for example, typically the case for a levelling tool when repositioning the tool at the beginning of a concrete surface). In this case, although the power deployed by the hydraulic jack is low, its speed is limited by the maximum flow rate available, so the arm moves slowly. The use of an electric motor compensates for this defect and allows the speed of the motor to be increased while remaining at its nominal power in such a case, from which the arm is moved more quickly and the repositioning time of the tool is reduced, making the use of the machine according to the invention more efficient for treating concrete surfaces.

The person skilled in the art will understand that the above electric motor considerations in the present document are beyond the framework of the present invention as claimed in claim 1 and could be the object of an invention in its own right, comprising for a machine comprising stabilizing feet.

The belt typically mechanically couples the electric motor and the arm by engaging both sides. The belt is toothed to prevent slippage and transmit more torque between the arm and the electric motor. A toothed belt also has the advantage of being suitable for the arrangement of a revolution sensor (or encoder) thereon or at the level of its drive by the electric motor. Specifically, this sensor is arranged on a drive pulley of the belt, for example. This sensor can then be used to determine the position of the arm and/or the tool according to the number of revolutions performed by the belt, for example, determined at the level of the pulley. This data can then be used to regulate the speed of displacement of the arm along the direction of extension, in particular during its deployment, to prevent it from abutting at the end-of-stroke due to its limited maximum extension length, which could damage the belt and/or the electric motor. This regulation is in particular the object of a method (A) explained below.

According to an embodiment of the invention, the treating tool is mechanically coupled to the end of the arm via a tool-carrying structure which is attached to the end of the arm, and on either side of which are arranged two tool-carrying elevating jacks for modifying an elevation of the latter. This enables to adapt the height of the tool according to the quality and the fluidity of the concrete, the desired levelling tolerance and/or other parameters. The two elevating jacks are preferably hydraulic jacks. However, other types of jacks, such as electric actuators, would not be outside the framework of the invention.

The determination of the elevation (or height) of the tool is usually based on a laser system as known to a person skilled in the art. More precisely, a reference plane is generated, in the operating area of the machine, by means of a source of one or more laser beams. This reference plane can then be sensed by dedicated receivers mounted on the tool to allow to ensure that the tool remains at a desired elevation relative to this reference plane. If there is any deflection from this desired elevation, the above-mentioned elevating jacks allow to adjust the elevation of the tool.

The machine, in particular the tool, and the operating area of the machine are preferably equipped with this technology. In the case of a levelling tool for the concrete surface, this is very advantageous to level the surface sufficiently flat and at the right height. This operation is often referred to as "laser screed".

However, the use of this technology can be hindered if there is a physical obstacle between the source of the laser beam or the laser beams and the receivers mounted on the tool, because then the receivers cannot sense the reference plane. To overcome this difficulty, each of the elevating jacks is preferably equipped with a position sensor. Thus, when one or more of the receivers are no longer receiving the reference plane, the elevation of the tool via the corresponding elevating jack or jacks can be calculated on its last known position value or values thanks to the position sensor or sensors. The corresponding regulation of the elevation of the tool is the object of a method (B) explained below.

The aforementioned regulation of the displacement speed (or of the position) of the arm and/or the elevation of the tool, and/or the positional control of the machine according to the invention can be done completely manually by an operator by means of manual controls placed on the machine, for example via the aforementioned positional data or sensor data received on an interface.

Preferably, the machine comprises a central computer module adapted to assist the operator in all or part of these regulations and/or this control, for example by controlling in an automated way all or part of the regulations and/or certain steps of the control of the machine. In this case, the operator is still adapted to control the machine manually at any time, but components of the operation of the machine can also be controlled automatically by this central computer module. In this case, it is of course necessary that the machine is equipped with the sensors corresponding to the components in question, or any other equivalent element, and that these are coupled (electrically and/or electronically) to the central information module so that the latter is able to base its control based on the data received from the sensors. A coupling (electronic and/or electromechanical) is then also provided between the central computer module and the portions of the machine to be actuated and/or acted upon to accomplish the desired control of the components of the operation of the machine. Thus, for example, in order to regulate the elevation of the tool, it is necessary that the central computer module can receive data from the receivers and/or position sensors, and activate the two corresponding elevating jacks.

The person skilled in the art will understand that the considerations relating to the central computer module in the present document, and the various methods associated therewith, go beyond the strict framework of the present invention as claimed in claim 1 and could be the object of an invention in their own right, comprising for a machine comprising stabilizing feet for those cases for which this is applicable.

Preferably, the central computer module is electronic in nature and is electrically, electronically and/or electromechanically coupled, as the case may be, to the wheels and/or electric motor or electric motors and/or jack or jacks and/or hydraulic system and/or sensor or sensors of the machine, according to the mechanical elements and the embodiment considered, in order to implement one or more of the above-mentioned regulation methods and/or to control the displacement of the machine at least according to a certain mode and/or under certain circumstances, for example, in the case of the treating method (C) explained below.

Preferably, when an axle comprises elevating means as mentioned above, a sensor, e.g. a magnetic sensor, is provided in the hydraulic jack arranged or coupled at the level of the pivot connection of each leg of the axle, to sense a position of the hydraulic jack and thus the distance between the chassis and the wheels supported by the axle. These magnetic sensors and the corresponding hydraulic jacks can be coupled to the central computer module, which will be configured, for example, to regulate an inclination of the arm according to the positions of the hydraulic jacks. These couplings can, for example, be used to regulate the elevation of the tool in combination with the couplings of the electronic data module with the position sensors and the hydraulic elevating jacks introduced above.

In the case of this document, the words "based on" referring to a determination, a regulation or a calculation based on parameters or data should not be interpreted as limiting and/or exhaustive.

Some of the above-mentioned methods that can be implemented with the machine according to the invention are introduced below. The embodiments and the advantages of the machine according to the invention are mutatis mutandis applicable to these methods.

In particular, the invention proposes a method (A) for regulating a displacement speed of the arm of the machine in the context of the above-described embodiments with reference to the method (A). The present method is therefore applicable for a machine equipped with an electric motor arranged in the chassis in order to move the arm (by deploying or retracting it) via a belt at the level of which a revolution sensor is arranged. The method comprises a closed-loop regulation of the displacement speed of the arm, typically implemented by computer coupled to said revolution sensor and said electric motor, for example by means of a central computer module as introduced above, based on data measured by the revolution sensor. The deployment speed of the arm can be reduced when it is almost fully deployed to prevent it from damaging the belt or the electric motor by abutting on a limit of its extension.

Preferably, the method (A) applies for a machine also verifying the context of the embodiments described above with reference to the method (B). The tool is then carried by elevating jacks to modify its elevation, each of which is equipped with a position sensor. In this case, the regulation of the displacement speed of the arm, typically implemented by computer also coupled to the position sensors, for example by means of the central computer module, is preferably done in a closed loop based on data measured by both the revolution and position sensors.

This embodiment of the method (A) allows for a better regulation of the speed of the arm as it retracts. Indeed, taking into account the elevation of the tool allows to take into account the force that the concrete exerts on the tool, and thus on the arm, and to better adapt the speed of retraction of the arm to this elevation according to the nature of the treating. For example, in the case of a levelling tool, it is possible to determine this speed according to the desired levelling quality (fine or standard, for example) and the elevation of the tool. For example, this quality can be pre-programmed at the level of the central computer module in the form of options that the operator of the machine only has to select via an interface, so that the speed of displacement of the arm is automatically regulated, in a quality-specific manner, in a closed loop based on the data measured by the revolution and position sensors.

The invention also proposes a method (B) for regulating an elevation of the tool in the context of the above-described embodiments with reference to the method (B). The method applies to a machine where the tool is carried by elevating jacks to change its elevation, each of which is equipped with a position sensor as described above. In this case, the method comprises a regulation of the elevation of the tool, typically implemented by a computer coupled to the position sensors and elevating jacks, for example by means of a central computer module as introduced above, in a closed loop based on a data of fluidity (and/or quality) of the concrete and of data measured by the position sensors. The method allows to ensure that the elevation of the tool corresponds to a desired elevation during the operation of the machine. In particular, the method is particularly advantageous when this elevation is controlled based on the laser reception of a reference plane as described above, because it then allows to supplement and/or substitute it temporarily.

More precisely, the method (B) can be completed as follows:

- as long as at least one laser beam can be received by each of the receivers:
  - determining the position data resulting from the position sensors as being those corresponding to the reference plane given the instantaneous adjustment in position of the elevating jacks which is made possible via the receivers;
  - storing (e.g. by means of a data support of said central computer module) the difference between the position data resulting from the two position sensors;
- when one of the receivers no longer receives a laser beam, estimating the elevation of the tool on that side, i.e., at the level of that receiver, relative to the reference plane, as the difference between the position data resulting from the position sensor on that same side and the position data from the other position sensor corrected by said stored difference.

These steps provide an example of practical implementation of the method (B) in the case of emission of a reference plane in the environment in which the machine operates. If the receivers receive the laser beam or laser beams that correspond to the reference plane, the closed-loop regulation based on the position data resulting from the position sensors is based in particular on the fact that the position data correspond to the positional adjustment of the jacks obtained via the receivers anyway. Such a regulation is of course always possible independently of this context, in particular when the target position data is known at the level of the concrete surface.

Another advantage of using position sensors via the method (B) is that it avoids the use of an inclinometer measuring a roll angle at the level of the tool as additional data to that obtained via the receivers. Indeed, the signal of such an inclinometer could be disturbed by the vibrations of the tool, which would reduce its reliability.

As in the method (A), the concrete fluidity (or quality) data can be a variable corresponding to a desired elevation of the tool and can be pre-programmed at the level of the central computer module in the form of options that the operator of the machine only has to select via an interface, so that the elevation of the tool is automatically regulated, in a fluidity-specific manner, in a closed loop based on data measured by the position sensors. This is specifically advantageous because the operator of the machine does not need to specifically set the elevation of the tool, as the central computer module is configured for this purpose based on the fluidity data. This saves time, in particular since this fluidity can change during the course of a day of operation with the machine. This means that it is not necessary to provide for installation times in order to set again the elevation of the tool according to the variation in the fluidity of the concrete, as the communication of the variation in question by means of a simple option on the interface is sufficient in this respect. This embodiment is advantageous in the case of a levelling tool where the fluidity of the concrete usually has a significant influence on the result obtained by the machine. The fluidity data of the concrete is for example to be chosen or considered among "slump ranges" (for example S1, S2, S3, S4 or S5).

The invention also proposes a method (C) for treating a succession of similar concrete surfaces aligned along a guiding direction, by means of the machine according to the invention, the latter further comprising at least one rotary sensor (or encoder) arranged at the level of at least one of the wheels in order to measure a distance travelled by this wheel. The method (C) then comprises the following steps:

- (0) positioning the machine opposite the first concrete surface to be treated in the succession, so that the direction of extension overcomes the concrete surface, with the wheels of the machine being oriented according to the guiding direction;
- (i) treating the concrete surface by means of the machine;
- (ii) moving the machine by a predetermined distance so that the direction of extension overcomes the next concrete surface to be treated in the succession, which comprises an end overlapping strip with the concrete surface treated in the step (i) extending parallel to the direction of extension;
- (iii) iterating the steps (i) and (ii);

the step (ii) being regulated by means of a central computer module of the machine coupled electronically and/or electromechanically to the wheels and based on data received from the at least one rotary sensor.

This method (C) is made possible by the orientable nature of the wheels and their ability to support the machine regardless of the position of the tool. In particular, the method (C) allows a large number of concrete surfaces to be treated in quick succession without the need to place and remove stabilizing feet from the machine. In particular, the machine displaces "crab-like".

The orientation of the wheels in the guiding direction and the displacement of the machine by a predetermined distance also allows to eliminate the need to waste time for adjusting manually "watching" the position of the machine when the concrete surfaces are similar and aligned. The method (C) can be adapted and/or completed by a step (ii)' consisting of a positional adjustment of the machine for concrete surfaces that are not similar along the direction of extension, but remain aligned. The wheels are then preferably reoriented according to the guiding direction, if necessary, before or after the treating.

Preferably, the predetermined distance is the difference between the width of the tool and that of the end overlapping strip, these widths being measured in the guiding direction.

The purpose of the end overlapping strip is to provide a clean junction between the treating of a concrete surface and the adjacent concrete surface. It is especially useful when the tool is levelling out these concrete surfaces because the edge of such a surface tends to sag after levelling when it is not held (and thus when it abuts a surface without concrete, or on which the concrete has not yet been levelled).

The electronic and/or electromechanical coupling of the wheels with the central computer module is similar to that discussed above. It preferably concerns the electric advancement motors in the hubs of the wheels and the gyration means for the wheels according to the related embodiments. Thus, the central computer module can control the advancement and the orientation of the wheels based on the data received from the rotary sensor or sensors. This is possible because they provide an information on the distance travelled by the wheel or the wheels, thus the distance to be travelled to move the machine by the predetermined distance.

Preferably, the step (ii), although regulated by the central computer module, is started based on an instruction received from the operator of the machine, for example via an interface, when the step (i) is completed.

The invention finally proposes a method for manufacturing a concrete surface comprising a use of a machine according to the invention to treat the concrete surface. The case where the treating is a levelling (and thus where the tool is dedicated to this treating) is preferred but the invention is not limited to it.

The disclosed subject matter is further introduced in the claims. As it will be understood by a skilled person from the disclosure, any one of the embodiments presented in these claims can be considered alone or in combination. In particular, the dependency of the claims can be considered in a broader manner so that any one of the possible combinations of the claims—as far as they are technically possible and understood by the person skilled in the art, in particular in view of the present disclosure—are part of the present application.

BRIEF DESCRIPTION OF THE FIGURES

Further characteristics and advantages of the present invention will become apparent from the following detailed description, for the understanding of which reference is made to the attached figures, among which.

Figure 1:
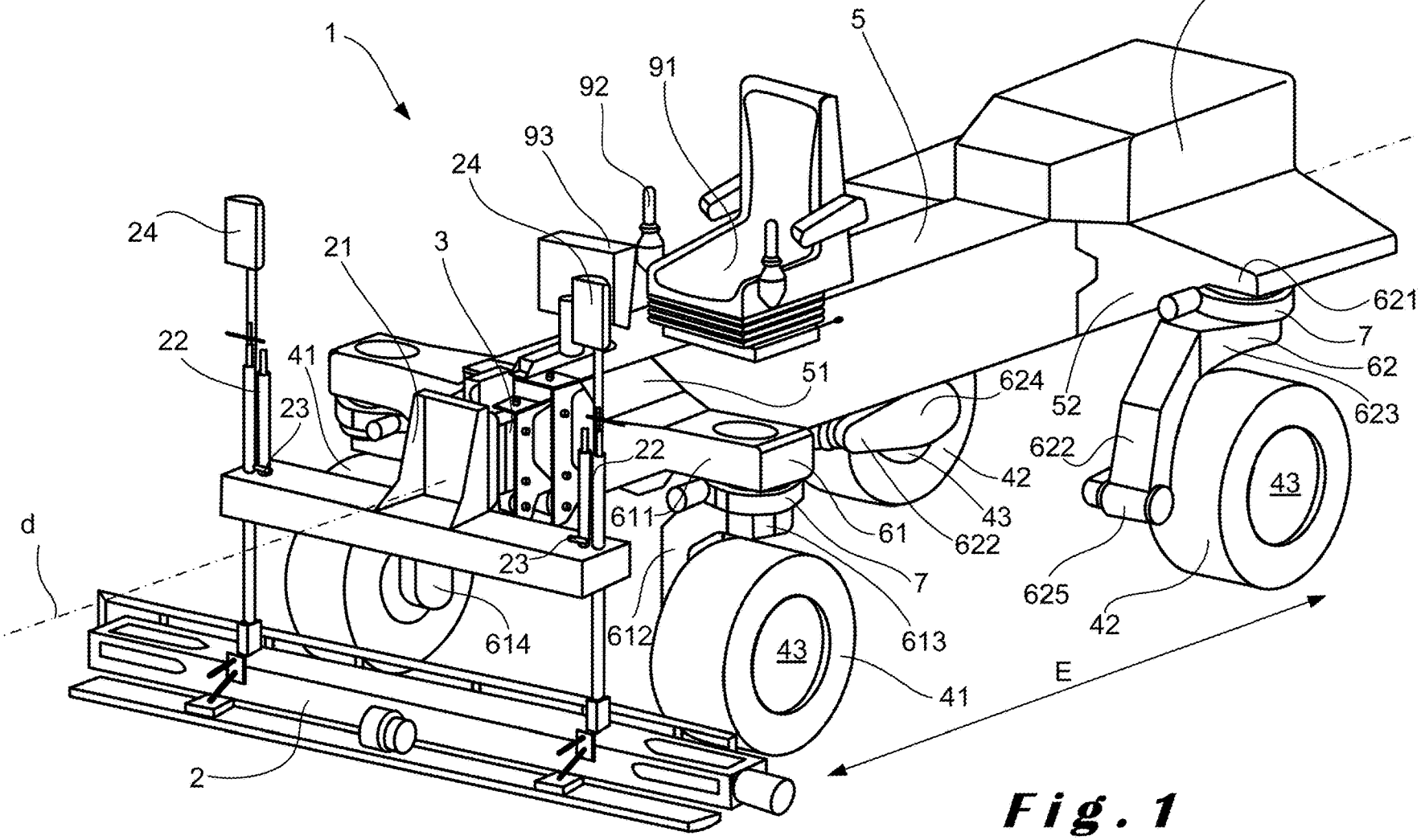
FIG. 1 represents a global three-dimensional view of a machine according to a preferred embodiment of the invention when its arm is retracted into the compartment.

The figure drawings are generally not to scale. Similar elements may be denoted by similar references in the figures. In particular, the same or similar elements may have the same references. In addition, the presence of numbers or letters referring to the drawings is not limiting, in particular when these numbers or letters are indicated in the claims.

DESCRIPTION OF EMBODIMENTS OF THE INVENTION

A detailed description of preferred embodiments of the invention is presented. This is described with particular embodiments and references to figures, but the invention is not limited by them. The drawings or figures described below are schematic only and are not limiting.

In particular, the embodiments described below relate to the case where the treating is a levelling. In particular, the machine is a leveler for uncured concrete surfaces and the tool is a levelling tool dedicated to this purpose. However, the invention is not limited to this.

The tool in question is shown in FIG. 1 and referenced by 2. It comprises a head formed by a screeding rule arranged to displace on a concrete surface by the machine 1. This head allows to establish a desired slope on the concrete surface. This tool 2 is widely known to the person skilled in the art.

The tool 2 is mechanically coupled to the end of a telescopic arm 3, which allows the aforementioned displacement along an extension direction d. The mechanical coupling is done via a tool-carrying structure 21 attached to the end of the arm 3 supporting the tool 2. Two hydraulic elevating jacks 22 are arranged on either side of the tool-carrying structure 21 and allow to support the tool 2 at its ends. These jacks allow to modify the elevation of the tool 2 at its ends. Each is overcome with a laser receiver 24 for detecting a laser reference plane generated in the operating environment of the machine 1 as described in the disclosure of the invention. The hydraulic elevating jacks 22 are known to be controlled based on signals emitted from these receivers 24, so as to control the elevation of the tool 2 with respect to the reference plane and to ensure that the levelling is done according to the desired slope and/or plane.

In the case of the embodiment shown in FIG. 1, the hydraulic elevating jacks 22 are each equipped with a position sensor 23 which also allow the elevation of the tool 2 to be regulated as detailed in the disclosure of the invention, particularly when laser reception is compromised.

The machine 1 comprises a main and central chassis 5 extending mainly along the extension direction d, in which a hollow compartment for the arm 3 is formed when the latter is retracted. The chassis supports a manual control area of the machine 1 comprising a seat 91 for an operator, control commands 92 (for example in the form of joysticks potentially comprising buttons) and a preferably interactive screen 93. The operator can manually control all the operations of the machine 1 by means of the control commands 92 and possibly via the screen 93. The screen 93 also allows the operator to supervise the operation of the machine 1. For example, a two-axis joystick of a control command 92 allows to control the direction and the acceleration of the machine 1.

The control data that follows the interactions of the operator with the control commands 92 and the screen 93 are transmitted through a central computer module 8 (or "central electronic module") arranged at the end of the chassis 5 opposite the arm 3 for reasons of balance of the centre of gravity of the machine 1. This central computer module 8 is coupled electrically, electronically and/or electromechanically as the case may be to the control commands 92, but to the components of the machine that allow to control the functionalities of the machine, and in particular to implement the instructions of the operator. Preferably, the machine 1 comprises sensors at the level of these components (e.g., the position sensors 23) coupled to the central computer module 8, so that it can automatically control at least one portion of the operations of the machine 1, and/or regulate parameters of the operation of the machine 1 as discussed in detail in the disclosure of the invention.

The machine 1 comprises two axles 61, 62, which are directly attached (or even extend from where appropriate) at the level of two end segments 51, 52 respectively or the chassis 5. Each axle 61, 62 comprises an axial portion 611, 621 respectively extending perpendicularly to the direction of extension d, from the chassis 5, and two arcuate legs 612, 622 respectively of the wheel support, on either side of the axial portion 611, 621. Each of the legs 612, 622 comprises an upper end 613, 623 respectively mechanically coupled to an end of the axial portion 611, 621 by means of gyration means 7. These allow a relative rotation between the axial portion 611, 621 and the leg 612, 622 respectively. Such gyration means 7 can be realized as a hydraulic gyration motor mechanically coupled to an orientation ring gear.

A lower end 614, 624 of each leg 612, 622 is provided to be attached at the level of a hub 43 of a wheel 41, 42, respectively.

The machine 1 comprises at least two pairs of wheels 41, 42 supported by the axles 61, 62 respectively and mechanically coupled thereto. The hub 43 of each wheel 41, 42 is attached to a lower end 614, 624 of one of the legs 612, 622, and an electric motor for advancing the wheel 41, 42 is arranged therein. Thus, the wheels are independently orientable, preferably 360°. The machine can thus displace on its wheels 41, 42 via the above-mentioned electric motors in any direction by combining translation and rotation.

Figure 2C:
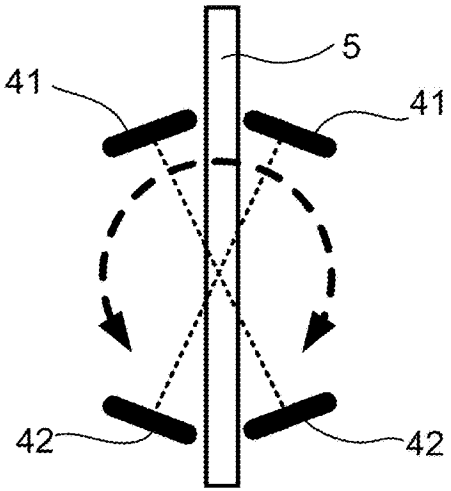
FIGS. 2A, 2B and 2C illustrate schematically from above the orientations of the wheels of the machine shown in FIG. 1.
Figure 2B:
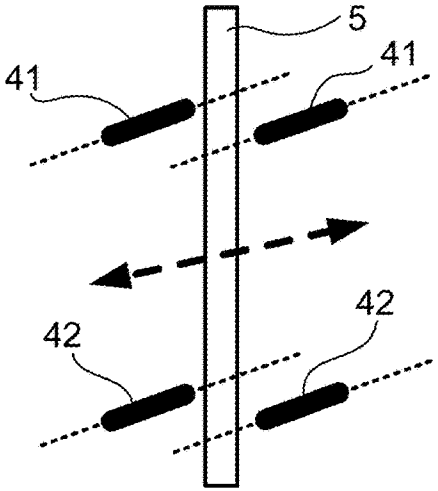
Figure 2A:
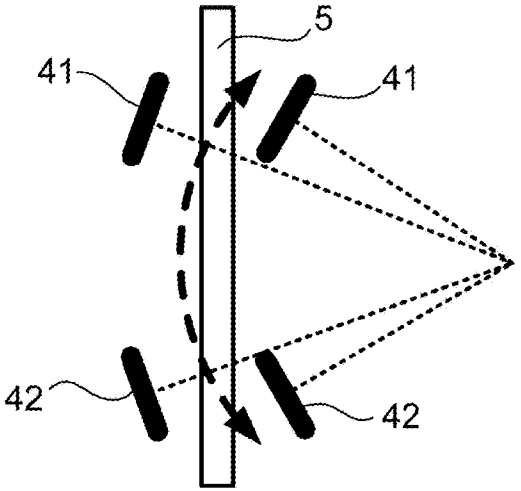

FIGS. 2A-C illustrate the freedom of the motions possible by means of these wheel-axle couplings on the chassis 5. In FIG. 2A, the wheels 41, 42 are oriented so as to displace the machine 1 longitudinally with a turning radius (counter-steering wheel mode). In FIG. 2B, the wheels 41, 42 are oriented so as to displace the machine 1 laterally in a "crab" manner (parallel wheel mode). In FIG. 2C, the wheels 41, 42 are oriented to make undergo a rotation of the machine 1 in place, which is useful for orienting the arm 3.

Figure 3:
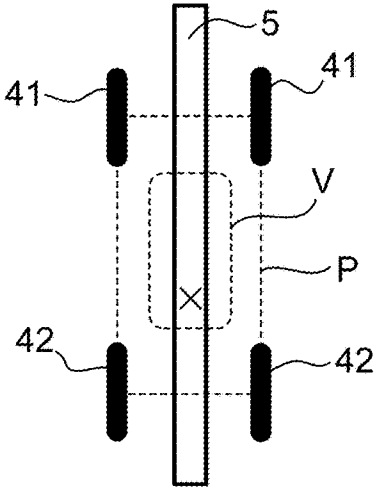
FIG. 3 illustrates schematically from above the positioning of the centre of gravity of the machine shown in FIG. 1 in relation to its wheels.

Since the axles 61, 62 supporting the wheels 41, 42 are attached at the level of the end segments 51, 52 respectively of the chassis 5, the wheelbase E of the machine 1 is 30 to 50% larger than in machines known in the prior art as described in the invention. It is made possible that the centre of gravity of the machine 1 is and remains in a space P between (or overcome) the wheels 41, 42 as shown in FIG. 3 where the centre of gravity is indicated by a cross, and this regardless of the position of the tool 2 along the extension direction d. This position, as well as other parameters (e.g. the inclination of the arm 3), is indeed likely to unbalance the machine 1 given the weight of the tool 2 and the arm 3. Due to the arrangement of the wheels 41, 42 and the axles 61, 62 directly on the end segments 51, 52 respectively of the chassis 5, the centre of gravity of the machine 1 remains in an area V within the space P. As a result, the machine 1 is supported and stabilized on its four wheels 41, 42 regardless of the position of the tool 2, without the need for stabilizing feet. The machine 1 does not comprise any.

In the case shown in FIG. 1, the rear axle 62 is equipped with elevating means arranged to allow a variation of a distance between the chassis 5 and the wheels 42 supported by the axle 62. In other words, they allow a variation in the height of the axle 62, thus of the rear of the machine 1, allowing to modify the inclination of the arm 3. In particular, when the arm 3 is deployed, it is useful to lower the rear of the machine 1 because the arm 3 tends to bend due to its weight. The elevating means comprises a pivot connection 625 in each leg 622 of the axle 62, with the two portions of the legs 622 articulating, on either side of the pivot connection 625. A hydraulic jack is arranged or coupled at the level of the pivot connection 625 to allow the above distance to be varied.

Figure 4:
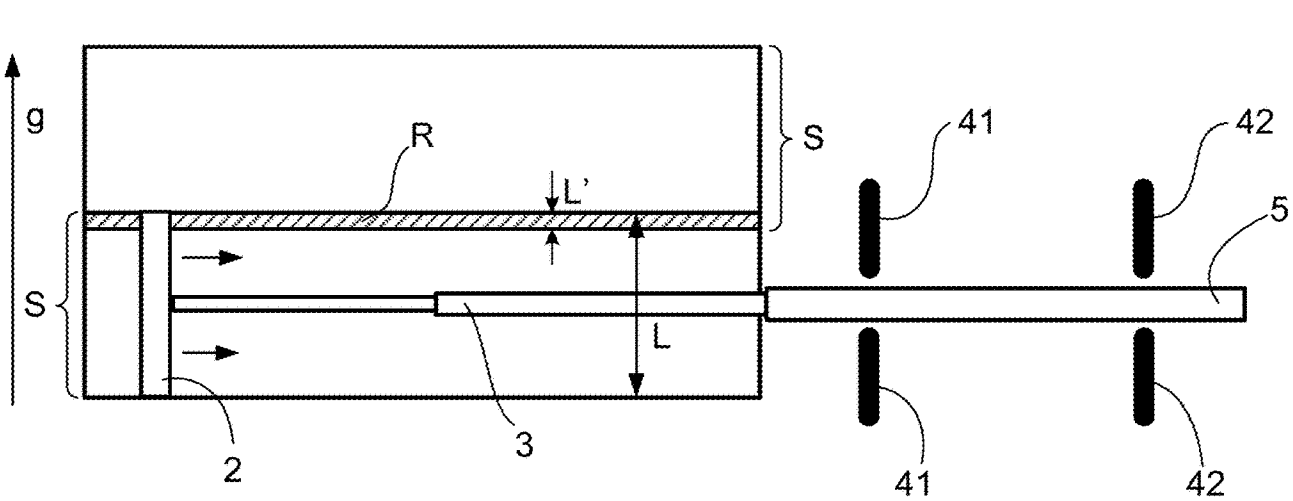
FIG. 4 illustrates schematically from above an embodiment of the method for treating successive concrete surfaces according to the invention and by means of the machine shown in FIG. 1.

FIG. 4 illustrates a portion of an execution of a method for treating similar concrete surfaces S aligned successively along a guiding direction g. In this case, a rotary sensor is arranged at the level of the wheels 41, 42 and coupled to the central computer module 8 to measure a distance travelled by the wheels 41, 42, and thus the machine 1.

The machine 1 is first positioned opposite the first concrete surface S to be treated, so that the extension direction d of the arm 3 overcomes the concrete surface S. The wheels 41, 42 of the machine are then oriented in the guiding direction g.

The concrete surface S is then levelled. To do this, the arm 3 is extended over the concrete surface S and then retracted in the direction of the machine 1, as shown in FIG. 4. The central computer module 8 allows to automatically regulate various aspects of this step, and in particular the inclination of the arm 3 via the hydraulic jacks coupled at the level of the pivot connections 625, the retraction speed of the arm 3, the elevation of the tool 2, etc., as detailed in the disclosure of the invention, and this potentially based on data introduced by the operator by means of the control commands 92 or the screen 93, such as the fluidity data of the concrete and/or the desired quality of the levelling.

The central computer module 8 allows, based on the data received from the rotary sensors, to control a displacement of the machine 1 (whose wheels 41, 42 are already oriented "in crab" towards the next concrete surface S) by a predetermined (and/or pre-programmed) distance equal to the width L of the tool 2 from which is deducted the desired width L' of a possible end overlapping strip R, this width L' being able to be null in the case where no such strip would be necessary. However, this width L' is preferably non-zero, especially in the case of a levelling machine.

The levelling of the concrete surfaces S is thus made simple and efficient for the operator, thanks to the orientation of the wheels 41, 42, their capacity to support and stabilize the machine 1 in all circumstances, the presence of the central computer module 8 which allows to control the displacement of the machine 1 and to regulate various parameters of its operation.

In brief, the present invention relates to a machine 1 for treating a concrete surface comprising a treating tool 2 mechanically coupled to one end of a telescopic arm, a chassis 5 in which a compartment for the arm 3 is formed, as well as two axles 61, 62 attached at the level of two respective end segments 51, 52 of the chassis 5 each supporting at least one wheel 41, 42. The wheels 41, 42 are orientable and their arrangement via the above-mentioned axles 61, 62 and chassis 5 is such that they allow the machine 1 to be supported whatever the position of the tool 2 and the arm 3.

The invention has been set forth and described in this document in relation with specific embodiments having a purely illustrative value. These should not be considered as limiting. More generally, it will be apparent to one person skilled in the art that the present invention is not limited to the examples illustrated and/or described above.

The invention claimed is:

1. A machine for treating a concrete surface comprising:
a tool for treating a concrete surface mechanically coupled to one end of a telescopic mechanical arm, so that the tool is movable over the concrete surface along a direction of extension of the arm;
a hollow compartment for the arm;
wheels coupled to the compartment and arranged to move the machine;
wherein the compartment is formed in a chassis of the machine extending mainly along the direction of extension,
wherein the chassis comprises two end segments at the level of each of which is attached at least one axle extending transversely to the direction of extension and supporting at least one of the wheels,
wherein each axle comprises:
an axial portion extending mainly transversely to the direction of extension, from the chassis;
two legs each of which comprises:
an upper end mechanically coupled to one end of the axial portion by means of gyration means arranged to allow a rotation relative between the axial portion and the leg,
a lower end attached at the level of a hub of one of the wheels;
and wherein at least one of the axles comprises elevating means arranged to allow a variation of a distance between the chassis and the at least one wheel supported by the axle.

2. The machine according to claim 1, having a wheelbase measured along the extension direction of between 35% and 65% of a maximum extension length of the arm measured along the extension direction.

3. The machine according to claim 1, wherein the gyration means comprises a gyration motor mechanically coupled to an orientation ring gear.

4. The machine according to claim 1, wherein each leg is arcuate, with the upper and lower ends being aligned in a direction orthogonal to the direction of extension.

5. The machine according to claim 1, wherein each leg of the axle comprises a pivot connection about which two portions of the leg articulate, the elevating means comprising a hydraulic jack arranged or coupled at the level of the pivot connection.

6. The machine according to claim 1, wherein each wheel comprises a hub within which an electric motor for advancing the wheel is arranged.

7. The machine according to claim 1, comprising an electrical power supply coupled to at least one electric motor and a hydraulic system for powering functionalities of the machine, which comprise any displacement of the wheels, the arm, and the tool.

8. The machine according to claim 1, consisting in a leveler for levelling a concrete surface, wherein the tool is a levelling tool.

9. The machine according to claim 1, comprising an electric motor arranged in the chassis for moving the arm by means of a belt, preferably toothed, engaged at the level of the electric motor.

10. The machine according to claim 1, wherein the tool is mechanically coupled to the end of the arm via a tool-carrying structure attached to the end of the arm on either side of which are arranged two elevating jacks carrying the tool for modifying an elevation of the latter, each elevating jack being equipped with a position sensor.

11. A method for regulating a speed of displacement of the arm of a machine according to claim 9, the machine further comprising:
an electric motor arranged in the chassis for moving the arm by means of a toothed belt engaged at the level of the electric motor, and
a revolution sensor for the toothed belt arranged thereat,
the method comprising a regulation of the speed of displacement of the arm in a closed loop based on data measured by the position and the revolution sensors.

12. A method for regulating an elevation of the tool of a machine according to claim 9, the method comprising a regulation of the elevation of the tool in a closed loop based on a fluidity data of the concrete and data measured by the position sensors.

13. A method for treating a succession of similar concrete surfaces aligned along a guiding direction, by means of a machine according to claim 1, the machine further comprising at least one rotary sensor arranged at the level of at least one of the wheels for measuring a distance travelled by that wheel, the method comprising the following steps:
(0) positioning the machine opposite the first concrete surface to be treated in the succession, so that the direction of extension overcomes the concrete surface, with the wheels of the machine being oriented according to the guiding direction;
(i) treating the concrete surface by means of the machine;
(ii) moving the machine by a predetermined distance so that the direction of extension overcomes the concrete surface to be treated next in the succession, which comprises an end overlapping strip with the concrete surface treated in the step (i) extending parallel to the direction of extension;
(iii) iterating the steps (i) and (ii);
the step (ii) being regulated by means of a central computer module of the machine coupled electronically and/or electromechanically to the wheels and based on data received from the at least one rotary sensor.

14. A method for manufacturing a concrete surface comprising a use of a machine according to claim 1 to treat the concrete surface.

15. A machine for treating a concrete surface comprising:
a tool for treating a concrete surface mechanically coupled to one end of a telescopic mechanical arm, so that the tool is movable over the concrete surface along a direction of extension of the arm;
a hollow compartment for the arm formed in a chassis of the machine extending mainly along the direction of extension;
orientable wheels supported by axles attached to the chassis to move the machine;
wherein each axle comprises:
an axial portion extending mainly transversely to the direction of extension, from the chassis;
two legs each of which comprises:
an upper end mechanically coupled to one end of the axial portion by means of gyration means arranged to allow a rotation relative between the axial portion and the leg,
a lower end attached at the level of a hub of one of the wheels;
and wherein at least one of the axles comprises elevating means arranged to allow a variation of a distance between the chassis and the at least one wheel supported by the axle;

wherein the wheels and the axles are arranged so that a gravity centre of the machine overcomes or is in a space between the wheels for any position of the tool along the direction of extension.

16. The machine according to claim 15, wherein the space corresponds to an inner space of a non-square rectangle having the wheels as vertices.

* * * * *